United States Patent [19]

Fresh

[11] Patent Number: 4,724,564

[45] Date of Patent: Feb. 16, 1988

[54] HOUSEHOLD SHOE CLEANING APPARATUS

[76] Inventor: Elwyn M. Fresh, 19 Buckingham Dr., Bella Vista, Ark. 72714

[21] Appl. No.: 915,661

[22] Filed: Oct. 6, 1986

[51] Int. Cl.[4] ..... A47L 23/02

[52] U.S. Cl. ..... 15/36; 15/37; 15/311

[58] Field of Search ..... 15/36, 37, 97 A, 311, 15/4, 34

[56] References Cited

U.S. PATENT DOCUMENTS

| | | | |
|---|---|---|---|
| 640,920 | 1/1900 | Kratofil et al. | 15/36 |
| 1,223,195 | 4/1917 | Molinaro | 15/36 |
| 1,359,193 | 11/1920 | Parker . | |
| 1,381,553 | 6/1921 | Hildreth et al. . | |
| 1,917,471 | 7/1933 | Uden . | |
| 2,264,153 | 3/1949 | Conklin . | |
| 2,895,159 | 7/1959 | Ostrow . | |
| 3,094,727 | 6/1963 | Osteen | 15/36 X |
| 3,115,653 | 12/1963 | Fresh et al. . | |
| 3,226,750 | 1/1966 | Leonard | 15/36 |
| 3,802,021 | 4/1974 | Shulz . | |

FOREIGN PATENT DOCUMENTS

| | | | |
|---|---|---|---|
| 1323751 | 3/1963 | France | 15/36 |

*Primary Examiner*—Edward L. Roberts

*Attorney, Agent, or Firm*—Litman, McMahon & Brown

[57] ABSTRACT

A shoe cleaning apparatus for household use includes a horizontal rotary brush to clean a toe portion of the sole of a shoe, a reciprocating brush to clean a heel portion of the shoe, and a vertical oscillating brush to clean side portions of the shoe. All the brushes are driven by a single motor which, along with the brushes, is mounted in a housing. A shoe rest bar extends across the housing between the rotary brush and the reciprocating brush. A user of the apparatus places an instep of the shoe on his foot on the shoe rest bar and pivots about the bar to vary the degree of engagement between portions of the shoe and the rotary and reciprocating brushes. The rotary brush includes baffles which cooperate with the rotary brush to create an airflow to carry away material removed from the shoe to a filter bag.

20 Claims, 6 Drawing Figures

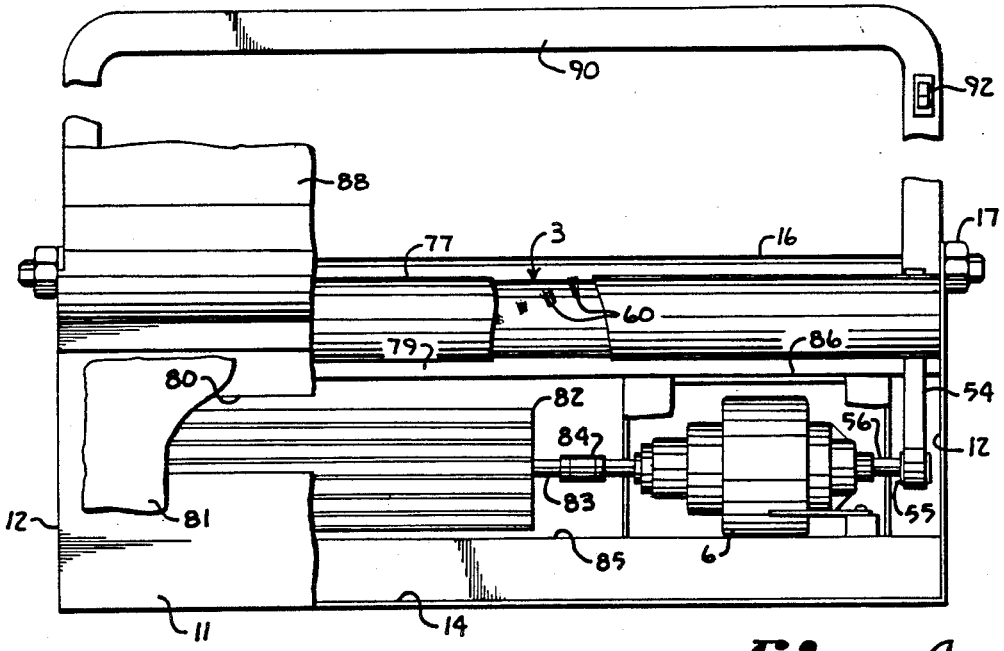
Fig. 4.
Fig. 5.
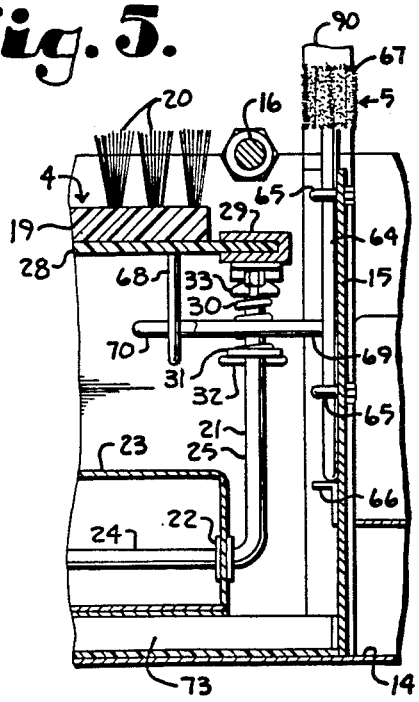
Fig. 6.
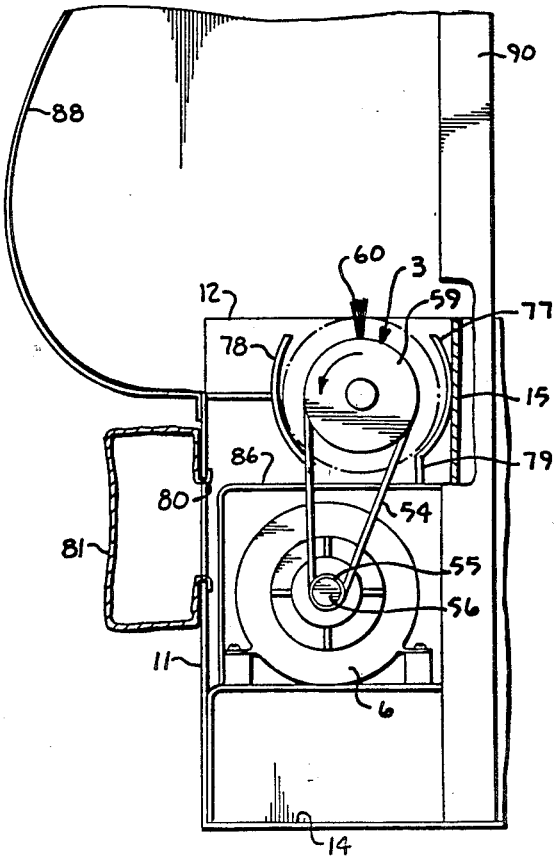

HOUSEHOLD SHOE CLEANING APPARATUS

FIELD OF THE INVENTION

The present invention relates to powered shoe cleaning devices and, more particularly, to such a device having multiple brushes for cleaning various parts of a shoe and adapted for household use.

BACKGROUND OF THE INVENTION

There have been a number of designs for devices to clean mud, grass, and the like from the shoes of persons prior to entering a building to reduce the amount of such materials tracked in and thereby preserve the appearance of such buildings and reduce maintenance costs. The majority of such shoe cleaning devices have been of the nature of so-called mechanical door mats, such as U.S. Pat. No. 3,115,635 of which I am a co-inventor. Such door mats tend to be large and complex and are generally designed to be inset or built into a sidewalk in front of a door of an office building, store, or apartment building of some size or in an entry way of such a building. Such devices usually include a grate to support the entire weight of one or more pedestrians, a plurality of brushes with bristles extending through the grate, and a motor of some sort which is engaged with the brushes to effect a motion which will clean at least the sole and heel portions of the shoes of persons supported by the grate.

Because of the size and expense of such devices, they are generally not suitable for installation in front of the doors of private homes or individual apartments. However, the shoe cleaning benefits of such a device are no less desirable in private homes, small stores, or individual offices.

SUMMARY OF THE INVENTION

The present invention provides a shoe cleaning apparatus which is particularly designed for use in households, individual offices, and small commercial establishments. The shoe cleaning apparatus includes a housing with a rotary brush for cleaning the soles of shoes, a reciprocating brush for cleaning the heels of shoes, and an oscillating brush to clean the sides of shoes mounted in the housing. The housing includes a shoe rest bar on which the user rests a shoe during cleaning and about which the user can pivot the shoe to vary the degree of contact between the shoe and, particularly, the rotary brush. The shoe rest bar helps the user maintain his balancing during use. A hand rail extending upwardly from the housing is also provided to assist the user in maintaining balance.

A single rotary motor drives all three brushes. An endless belt is engaged between the motor shaft and the rotary brush to rotate same. A cylindrical cam arrangement receives rotation from the motor and converts the rotary motion into reciprocating linear motion to drive the reciprocating brush. A loose link between the reciprocating brush and the oscillating brush transfers the linear reciprocating motion thereof to the oscillating brush as a rotary reciprocating motion or oscillating motion.

The bristles on the rotary brush are arranged in a helical pattern which aids in the cleaning of shoe soles having deep tread patterns, particularly, diagonally arranged patterns. The rotary brush has a pair of baffles extending therealong which in cross section spiral toward a lower side of the rotary brush. These baffles cooperate with the rotary brush in such a manner that when it is rotating, an airflow is created which carries away material removed from shoes by the rotary brush. The removed material may be deposited in a tray or dust receptacle positioned in a lower part of the shoe cleaner housing. Alternatively, the airflow may be directed into a filter bag such as by the use of a secondary fan to deposit the material in the filter bag.

OBJECTS OF THE INVENTION

The principal objects of the present invention are: to provide a shoe cleaning apparatus to remove and collect undesired material from shoes; to provide such an apparatus which is especially suitable for use in private homes and small business establishments; to provide such an apparatus which includes a rotary brush to clean a sole portion of a shoe, a reciprocating brush to clean a heel portion of a shoe, and an oscillating brush to clean side portions of a shoe; to provide such an apparatus in which all three brushes are driven by a single rotary electric motor; to provide such an apparatus including a shoe rest bar extending across the housing between the rotary and reciprocating brushes on which a user rests a shoe during cleaning and about which the user can pivot the shoe to vary the degree of contact between, particularly, the shoe and the rotary brush; to provide such an apparatus in which the bristles on the rotary brush are arranged in a helical pattern to enhance the cleaning of deep, diagonally treaded shoes; to provide such an apparatus including baffles positioned about the rotary brush and cooperating therewith during rotation of the brush to create an airflow which carries material removed from a shoe to a receptable or a filter bag; to provide such an apparatus which is light in weight and compact in size; and to provide such an apparatus which is economical to manufacture, effective in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a rear elevational view of the shoe cleaning apparatus with portions broken away to illustrate details of a rotary brush of the apparatus.

FIG. 5 is an enlarged fragmentary sectional view taken on line 5—5 of FIG. 2 and illustrates drive details of an oscillating brush of the apparatus.

FIG. 6 is a fragmentary left side elevational view of the shoe cleaning apparatus with a side wall removed to illustrate further details of the rotary brush.

DETAILED DESCRIPTION OF THE INVENTION

Figure 1:
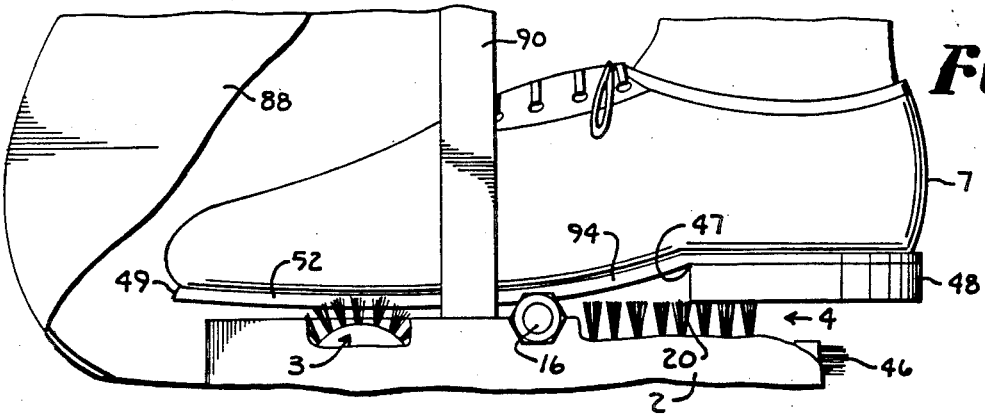
FIG. 1 is a fragmentary side elevational view of a portion of a shoe cleaning apparatus according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a shoe cleaning apparatus according to the present invention. The apparatus 1 generally includes a housing 2 having a rotary brush 3, a reciprocating brush 4, and an oscillating brush 5 mounted therein and driven by a motor 6 (FIG. 4) to clean a shoe 7.

Figure 2:
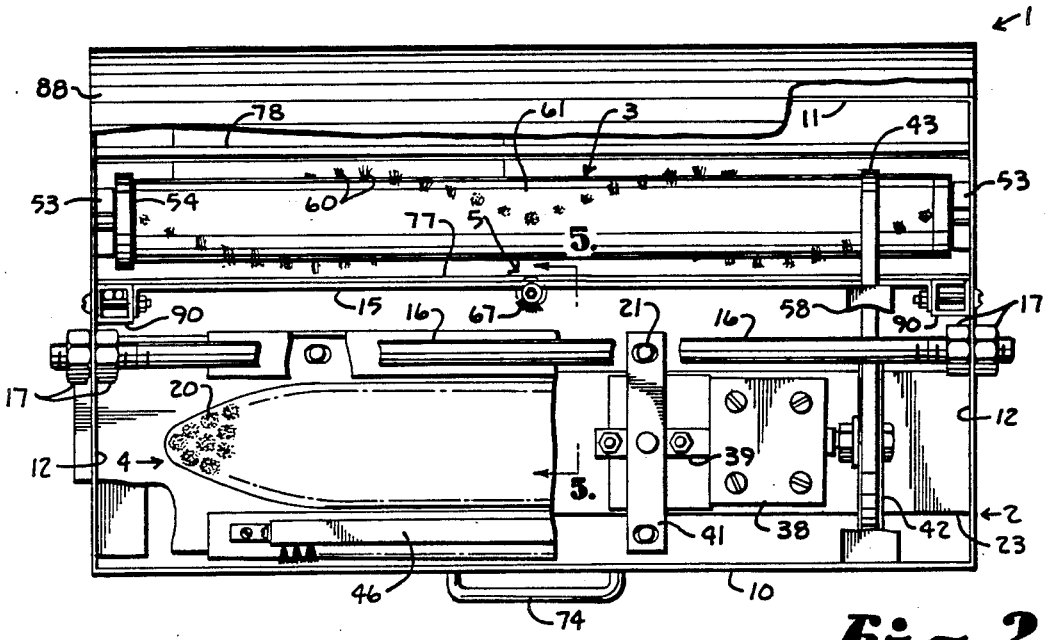
FIG. 2 is a plan view of the shoe cleaning apparatus at a reduced scale with portions broken away to illustrate operating components.
Figure 3:
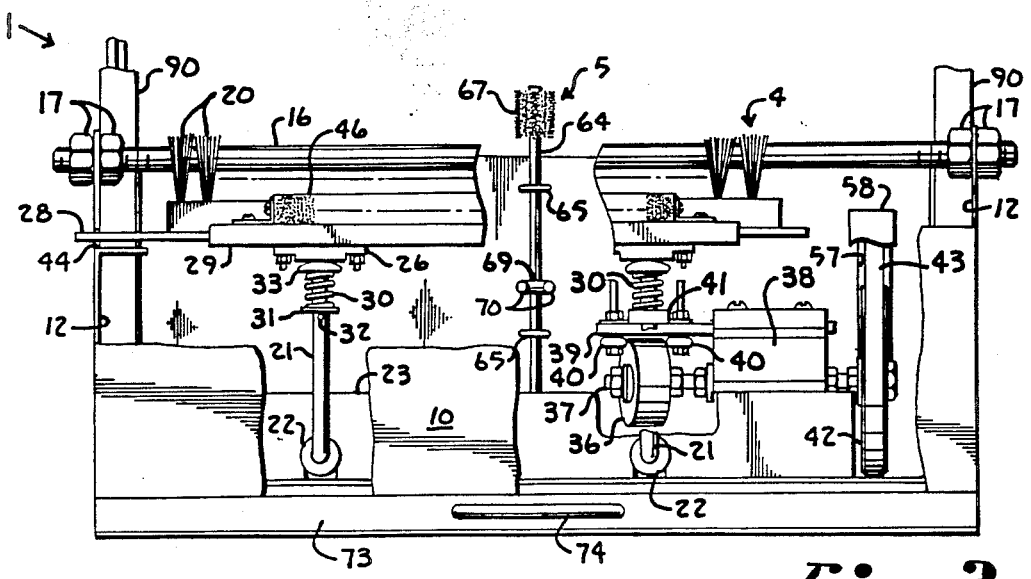
FIG. 3 is a frontal elevational view of the shoe cleaning apparatus with portions broken away to illustrate details of a reciprocating brush of the apparatus.

The housing 2 is formed by a front wall 10, a rear wall 11, and side walls 12. A lower side of the housing 2 is closed by a lower wall 14. The space enclosed by the housing 2 is divided by an intermediate wall 15 which also aids in stiffening the structure of the housing 2. The upper side of the housing 2 is open. The walls forming the housing may consist of sheet metal or any other suitable material. A shoe rest bar 16 extends between the side wall 12 in spaced relation to the intermediate wall 15. The shoe rest bar 16 may be attached to the side walls 12 as by double sets of nuts 17 threaded onto the ends of the bar 16 on opposite sides of each side wall 12, as illustrated in FIGS. 2 and 3. The bar 16 provides a rest for the user to place his shod foot during cleaning of a shoe to help the user maintain his balance and to control the degree of engagement between the brushes 3 and 4 by pivoting the shoe 7 about the bar 16.

The reciprocating brush 4 is positioned between the front wall 10 and the shoe rest bar 16 and is provided to clean a heel portion of a shoe 7. The brush 4 includes a horizontally oriented base 19 with upwardly directed bristles 20 which are positioned in groups over the area of the base 19. The brush 4 is operatively engaged with the motor 6 in such a manner that the brush 4 reciprocates in a lateral direction, that is, in a direction parallel to the shoe rest bar 16. The apparatus 1 may incorporate any suitable mechanism to transfer and convert the rotary motion of the motor 6 to a reciprocating motion to drive the brush 4.

Referring particularly to FIGS. 3 and 5, the illustrated reciprocating brush 4 is positioned on a pair of U-shaped rocker links 21 which are pivotally mounted in rocker bearings 22 positioned in a reciprocating brush mounting platform 23. The platform 23 is an inverted channel shaped member attached to, extending between the side walls 12, and spaced above the lower wall 14 of the housing 2. The illustrated platform 23 is formed of sheet metal, and the rocker bearings 22 are a plastic, such as nylon. The rocker links 21 have cross bar portions 24 which are positioned in the bearings 22 and upwardly extending legs 25 which extend through rocker thrust bearings 26 in the lower side of the base 19 of the brush 4. The base 19 of the brush 14 is affixed to a mounting plate 28 which has reinforcing channels 29 encased about peripheral portions of the plate 28. The upper ends of the rocker link legs 25 extend into apertures (not shown) formed in the mounting plate 28, in lower flanges of the channels 29, and in the thrust bearings 26.

In order to better distribute the reaction forces exerted on the channels 29 by the ends of the legs 25 when weight is applied to the brush 4, contact between the legs 25 and the brush 4 is cushioned by spring members 30. The spring members 30 are held in position by lower washers 31 and pins 32. The upper ends of the springs 30 have curved or cylindrically shaped washers 33 which engage the thrust bearings 26. The position of the curved washers and the spring constant of the springs 30 is such that when no weight is applied to the brush 4, the ends of the legs 21 extend only into the bearings 26 but do not contact the upper flanges of the channels 29. As increasing downward force is applied to the brush 4, the ends of the legs 21 bottom out in their apertures; however, at the same time, a large proportion of the contact pressure occurs between the curved washers 33 and the thrust bearings 26. The arrangement of the springs 30 also helps to quiet the operation of the reciprocating brush 4.

In the illustrated apparatus 1, the reciprocating brush 4 is driven by a cylindrical cam 36 operatively engaged with one of the rocker links 21. Referring to FIG. 3, the cam 36 is affixed to a cam shaft 37 which is rotatably mounted in a bearing block 38 mounted on the platform 23. The cam member 36 is cylindrical in form and is positioned on the shaft 37 at a selected angle. A cam follower member 39 is slidably mounted in the bearing block 38 and has roller members 40 which engage the periphery of the cam member 36. The follower 39 is connected to a cross link 41 which is connected to one of the rocker links 21.

The cam shaft 37 extends through the bearing block 38 and has a pulley or sheave 42 affixed on the end opposite the end having the cam member 36. An endless belt 43 passes around the pulley 42 and around the rotary brush 3 such that when the rotary brush 3 is rotated, the cam member 36 is rotated. As the cam rotates, its angular orientation causes a reciprocating motion to occur in the cam follower 39 which is engaged with the cam 36. This reciprocation is thus transferred to the reciprocating brush 4. The motion of the brush 4 is in reality a recurring arcuate motion, but the arc length of the motion is so short that for all practical purposes the motion of the brush 4 has the effect of a linear reciprocation.

At least one end of the mounting plate 28 is constrained in the vertical direction to prevent the brush 4 from tilting when weight is applied to only one end. As illustrated in FIG. 3, an end of the plate 28 extends through a slot 44 formed in the left hand side wall 12. Alternatively, one end of the plate 28 could be positioned between ledges extending inwardly from one of the side walls 12 for this purpose. The reciprocating brush 4 preferably includes a forwardly directed auxiliary brush 46 for cleaning a rear instep portion 47 of a shoe 7 (FIG. 1) between the front surface of the heel 48 and the sole 49 of the shoe.

The rotary brush 3 is positioned on the opposite side of the intermediate wall 15 from the reciprocating brush 4 and is provided to clean a front or toe portion 52 of the sole 49 of the shoe 7. The rotary brush 3 is cylindrical in shape and is rotatably mounted in rotary bearings 53 positioned on the opposite side walls 12. The rotary brush 3 is rotated by the motor 6 through an endless belt 54 passing around a pulley 55 on a shaft 56 of the motor 6 and around an end portion of the rotary brush 3. As described previously, the belt 43 which drives the reciprocating brush 4 also passes around the rotary brush 3 and is driven thereby. The belt 43 passes through an opening 57 in the intermediate wall 15 to reach the pulley 42. A guard member 58 is preferably positoned over the belt 43 to prevent accidental access thereto.

In construction, the rotary brush 3 includes an elongated cylindrical base 59 with bristles 60 extending radially therefrom. The base 59 may be formed of a material such as a plastic or wood. In a preferred embodiment of the apparatus 1, the bristles 60 are grouped in bundles which are arrayed on the base 59 in a helical manner. As illustrated in FIG. 2, the bundles of bristles 60 are positioned in diametrically opposed helical rows which originate at a center portion 61 of the base 59 and which progress helically toward the ends of the rotary brush 3. The rows of bristles 60 on the left side of the brush 3 are arrayed in left hand helixes while those on the right side extend in right hand helixes. However, the directions of the helixes depend on the direction of rotation of the rotary brush 3. The illustrated rotary brush 3 rotates in a counterclockwise direction as viewed in FIG. 6, that is, in a direction from the front wall 10 toward the rear wall 11 on the upper side of the rotary brush 3. The helical arrangement of the bristles 60 is believed to aid in the removal of material lodged in recesses of diagonally treaded soles of shoes such as certain kinds of athletic shoes, hiking boots, and work boots.

The oscillating brush 5 is positioned for rotary oscillation about a vertical axis at the approximate lateral center of the housing 2. The illustrated oscillating brush 5 includes an elongated shaft 64 which is rotatably mounted on the intermediate wall 15 as by means of a pair of short legged U-bolts 65. The position of the shaft 64 is fixed in a downward direction by a ledge 66 (FIG. 5), such as a small inverted L-shaped bracket, which is affixed to the intermediate wall 15. The brush 5 has a plurality of bristles 67 which radiate horizontally in a cylindrical pattern from an upper end of the shaft 64. The length of the shaft 64 is such that the bristles 67 are positioned at a level above the upper edge of the intermediate wall 15.

The illustrated oscillating brush 5 is driven by the reciprocating motion of the reciprocating brush 4. Referring to FIG. 5, a post 68 extends downwardly from the underside of the mounting plate 28 of the brush 4. The brush 5 includes a forked arm 69 extending radially from the shaft 64 and having a pair of tines 70 which are positioned on opposite sides of the post 68. The fit between the tines 70 and the post 68 is preferably loose to avoid binding. As the brush 4 moves in its quasi-linear reciprocating motion, the motion is transferred through the post 68 and arm 69 to the shaft 64 of the brush 5 such that the brush 5 oscillates in a rotary manner. The oscillating brush 5 is provided to clean side portions of the sole 49 and heel 48 of the shoe 7.

Material which is removed from shoes by the apparatus 1 is preferably collected in the housing 2 for subsequent disposal. Referring to FIGS. 2, 3, and 5, the apparatus 1 is provided with a material collection tray 73 to collect material removed by the reciprocating brush 4 and the oscillating brush 5. The tray 73 is slidably received within the housing 2 just above the lower wall 14. A handle 74 is positioned on a front wall of the tray 73 for gripping to remove the tray 73 from the housing 2 for emptying. The tray 73 may be formed from a plastic which, preferably, has a low frictional coefficient with respect to the material from which the lower wall 14 and the side walls 12 are formed to avoid binding during insertion and removal of the tray 73.

The rotary brush 3 is provided with baffles 77 and 78 which cooperate with the brush 3 during rotation to create an airflow which carries away material removed from the shoe 7 by the brush 3 to a collection location. Referring to FIG. 6, the baffles 77 and 78 are shaped cross-sectionally to spiral toward the axis of rotation of the brush 3 from top to bottom. The front baffle 77 includes a depending flange 79 which deflects the airflow toward the rear wall 11 which has a slot 80 having a filter bag 81 mounted therein. The filter bag 81 is formed of air pervious similar to that used in the manufacture of vacuum cleaner bags. The material removed from a shoe 7 by the brush 3 is deposited in the filter bag 81 by the airflow created by the baffles 77 and 78.

In order to increase the velocity of the airflow and more positively direct it toward the slot 80 and filter bag 81, the apparatus 1 may include a fan member 82. The fan member 82 is a squirrel cage type of centrifugal fan which is mounted on a fan shaft 83 rotated by the motor 6. The fan shaft 83 is connected by a flexible coupling 84 to the motor shaft 56. The motor 6 is mounted on a motor platform 85 to position its shaft 56 in line with the desired axis of rotation of the fan shaft 83. The motor 6 is enclosed within a motor housing 86 to avoid contamination thereof by dirt and other material removed from shoes by the rotary brush 3.

The housing 2 may include a hood or cowling 88 which curves upwardly from the rear wall 11 to help deflect material removed from shoes back toward the housing 2 and the collection means therein. In order to help a user of the apparatus 1 maintain his balance during shoe cleaning, the apparatus 1 is provided with a rail 90 which extends upwardly from the housing 2 to a height which is just below the waist of an average size adult. The rail 90 also may be grasped to move or adjust the position of the apparatus 1. A switch member 92 which controls the operation of the motor 6 is positioned on the rail 90 at a convenient location.

In operation, a user operates the switch 92 to activate the motor 6 which drives the rotary brush 3, the reciprocating brush 4, and the oscillating brush 5. The user may grasp the rail 90 to steady himself as he places an instep area 94 of the sole 49 of one of his shoes 7 on the shoe rest bar 16. By pivoting the shoe 7 about the bar 16, the user may vary the degree of engagement of the sole 49 with the rotary brush 3 and the heel 48 with the reciprocating brush 4. Further cleaning is achieved by sliding the shoe 7 forward and backward along the brushes 3 and 4. The user may clean a rear instep area 47 of his shoe by placing the area 47 against the auxiliary brush 46. The sides of the sole 49 and the heel 48 may then be cleaned by sliding the sides along the oscillating brush 5. When the shoes have been thus cleaned, the apparatus 1 may be deactivated by operation of the switch 92.

It is to be understood that while certain forms of the present invention have been illustrated and described herein, it is not to be limited to the specific forms or arrangement of parts described and shown.

What is claimed and desired to be secured by Letters Patent is as follows:

1. A shoe cleaning apparatus comprising:

(a) a housing;

(b) an elongated rotary brush mounted on said housing to rotate about a horizontal axis;

(c) rotary motor means drivingly engaged with said rotary brush to rotate same;

(d) an elongated shoe rest bar mounted on said housing substantially parallel to said axis and positioned at a higher elevation than said axis such that a user rests an instep portion of the user's shoe on said bar and pivots the shoe thereon to thereby vary the degree of engagement between a sole of the shoe and said rotary brush;

(e) a reciprocating brush mounted on said housing to reciprocate in a direction substantially parallel to said axis, said reciprocating brush being positioned on an opposite side of said bar from said rotary brush to clean a heel portion of a shoe; and (f) reciprocating means drivingly engaged between said motor means and said reciprocating brush to cause said reciprocating brush to reciprocate.

2. An apparatus as set forth in claim 1 wherein said reciprocating means includes:

(a) a cam shaft rotatably mounted on said housing;

(b) rotation transfer means drivingly engaged between said motor means and said cam shaft; and (c) a cam member mounted on said cam shaft and operatively engaged with said reciprocating brush whereby rotation of said cam member causes the reciprocation of said reciprocating brush.

3. An apparatus as set forth in claim 1 including:

(a) a vertical shaft rotatably mounted on said housing adjacent said rod;

(b) an oscillating link attached to said vertical shaft and loosely connected to said reciprocating brush to transfer and convert the reciprocating motion of said reciprocating brush to said vertical shaft as oscillatory rotary motion; and (c) an oscillating brush mounted on said vertical shaft to clean side portions of a shoe by oscillatory rotary motion.

4. An apparatus as set forth in claim 1 including:

(a) a receptable removably positioned on said housing beneath at least one of said brushes to receive material removed from a shoe by said one brush, said receptacle being removable to empty same.

5. A shoe cleaning apparatus comprising:

(a) a housing;

(b) an elongated rotary brush mounted on said housing to rotate about a horizontal axis;

(c) rotary motor means drivingly engaged with said rotary brush to rotate same;

(d) an elongated shoe rest bar mounted on said housing substantially parallel to said axis and positioned at a higher elevation than said axis such that a user rests an instep portion of the user's shoe on said bar and pivots the shoe thereon to thereby vary the degree of engagement between a sole of the shoe and said rotary brush; and (e) fan means mounted on said housing and drivingly engaged with said motor means to create an airflow to control the collection of material removed from a shoe by said brush.

6. An apparatus as set forth in claim 5 including:

(a) an opening formed in said housing; and (b) filter means positioned in covering relation to said opening and cooperating with said fan means to collect material removed from a shoe by said brush.

7. A shoe cleaning apparatus comprising:

(a) a housing;

(b) an elongated rotary brush mounted on said housing to rotate about a horizontal axis;

(c) rotary motor means drivingly engaged with said rotary brush to rotate same;

(d) an elongated shoe rest bar mounted on said housing substantially parallel to said axis and positioned at a higher elevation than said axis such that a user rests an instep portion of the user's shoe on said bar and pivots the shoe thereon to thereby vary the degree of engagement between a sole of the shoe and said rotary brush; and (e) baffle means positioned about said brush and cooperating therewith during rotation of said brush to generate an airflow to draw away material removed from a shoe by said brush.

8. An apparatus as set forth in claim 7 wherein said brush is cylindrical and includes bristles extending therefrom, and said baffle means includes:

(a) a first baffle cross-sectionally shaped to spiral radially toward said brush in the direction of rotation of said brush;

(b) a second baffle cross-sectionally shaped to spiral radially away from said brush in the direction of rotation of said brush; and (c) said first and second baffles cooperating with said brush to form an air inlet on an upper side of said brush and an air outlet on a lower side of said brush.

9. A shoe cleaning apparatus comprising:

(a) a housing;

(b) an elongated rotary brush mounted on said housing to rotate about a horizontal axis, said rotary brush to clean a sole portion of a shoe;

(c) rotary motor means drivingly engaged with said rotary brush to rotate same;

(d) a reciprocating brush mounted on said housing to reciprocate in a direction substantially parallel to said axis, said reciprocating brush being positioned at substantially the same elevation as said rotary brush to clean a heel portion of a shoe;

(e) reciprocating means drivingly engaged between said motor means and said reciprocating brush to cause said reciprocating brush to reciprocate;

(f) an elongated shoe rest bar mounted on said housing substantially parallel to said axis and between said brushes, said bar being positioned at a higher elevation than said brushes such that a user rests an instep portion of the user's shoe on said bar and pivots the shoe thereon to thereby vary the degree of engagement between the shoe and said brushes; and (g) a receptacle removably positioned on said housing beneath at least one of said brushes to receive material removed from a shoe by said one brush, said receptacle being removable to empty same.

10. An apparatus as set forth in claim 9 wherein said reciprocating means includes:

(a) a cam shaft rotatably mounted on said housing;

(b) rotation transfer means drivingly engaged between said motor means and said cam shaft; and (c) a cam member mounted on said cam shaft and operatively ergaged with said reciprocating brush whereby rotation of said cam member causes the reciprocation of said reciprocating brush.

11. An apparatus as set forth in claim 10 wherein:

(a) said cam member is a cylindrical cam;

(b) a cam follower is slidably mounted on said housing and engages said cam such that rotation of said cam causes said cam follower to reciprocate; and (c) said reciprocating brush is operatively connected to said cam follower such that the reciprocating motion of said cam follower is transferred to said reciprocating brush.

12. An apparatus as set forth in claim 9 including:

(a) a vertical shaft rotatably mounted on said housing adjacent said rod;

(b) an oscillating link attached to said vertical shaft and loosely connected to said reciprocating brush to transfer and convert the reciprocating motion of said reciprocating brush to said vertical shaft as oscillatory rotary motion; and (c) an oscillating brush mounted on said vertical shaft to clean side portions of a shoe by oscillatory rotary motion.

13. An apparatus as set forth in claim 9 including:

(a) an opening formed in said housing;

(b) filter means positioned in covering relation to said opening to collect material removed from a shoe by one of said brushes; and (c) fan means mounted on said housing and drivingly engaged with said motor means to create an airflow to deposit material removed from a shoe on said filter means.

14. An apparatus as set forth in claim 9 wherein:

(a) said rotary brush is substantially cylindrical including a cylindrical surface; and (b) said rotary brush includes a row of bristles extending radially from said cylindrical surface and arrayed helically about said cylindrical surface.

15. An apparatus as set forth in claim 14 wherein:

(a) said rotary brush has opposite ends and a middle portion; and (b) said row of bristles is arrayed in a right hand helix from said middle portion toward one end of said rotary brush and is arrayed in a left hand helix from said middle portion of said rotary brush toward an opposite end of said rotary brush.

16. An apparatus as set forth in claim 9 including:

(a) baffle means positioned about said rotary brush and cooperating therewith during rotation of said rotary brush to generate an airflow to draw away material removed from a shoe by said rotary brush.

17. An apparatus as set forth in claim 16 wherein said rotary brush is cylindrical and includes bristles extending therefrom and said baffle means includes:

(a) a first baffle cross-sectionally shaped to spiral radially toward said rotary brush in the direction of rotation of said rotary brush;

(b) a second baffle cross-sectionally shaped to spiral radially away from said rotary brush in the direction of rotation of said rotary brush; and (c) said first and second baffles cooperating with said rotary brush to form an air inlet on an upper side of said rotary brush and an air outlet on a lower side of said rotary brush.

18. An apparatus as set forth in claim 9 including:

(a) a hand rail extending upwardly from said housing to be gripped by a user to steady same during use of said apparatus.

19. A shoe cleaning apparatus comprising:

(a) a housing;

(b) an elongated rotary brush mounted on said housing to rotate about a horizontal axis, said rotary brush to clean a sole portion of a shoe;

(c) rotary motor means drivingly engaged with said rotary brush to rotate same;

(d) a reciprocating brush mounted on said housing to reciprocate in a direction substantially parallel to said axis, said reciprocating brush being positioned at substantially the same elevation as said rotary brush to clean a heel portion of a shoe;

(e) reciprocating means drivingly engaged between said motor means and said reciprocating brush to cause said reciprocating brush to reciprocate;

(f) an elongated shoe support bar mounted on said housing substantially parallel to said axis and between said rotary brush and said reciprocating brush, said bar being positioned at a higher elevation than said rotary and reciprocating brushes such that a user rests an instep portion of the user's shoe on said bar and pivots the shoe thereon to thereby vary the degree of engagement between the shoe and said rotary and reciprocating brushes;

(g) a vertical shaft rotatably mounted on said housing adjacent said rod;

(h) an oscillating link attached to said vertical shaft and loosely connected to said reciprocating brush to transfer and convert the reciprocating motion of said reciprocating brush to said vertical shaft as oscillatory rotary motion;

(i) an oscillating brush mounted on said vertical shaft at a higher elevation than said rotary and reciprocating brushes to clean side portions of a shoe by oscillatory rotary motion;

(j) baffle means positioned about said rotary brush and cooperating therewith during rotation of said rotary brush to generate an airflow to draw away material removed from a shoe by said rotary brush;

(k) an opening formed in said housing;

(l) filter means positioned in covering relation to said opening to collect material removed from a shoe by said rotary brush and carried by said airflow through said opening; and (m) a receptacle removably positioned on said housing beneath said reciprocating brush to receive material removed from a shoe by said reciprocating brush, said receptacle being removable to empty same.

20. A shoe cleaning apparatus comprising:

(a) a housing;

(b) an elongated rotary brush mounted on said housing to rotate about a horizontal axis;

(c) said rotary brush is substantially cylindrical including a cylindrical surface;

(d) said rotary brush includes a row of bristles extending radially from said cylindrical surface and arrayed helically about said cylindrical surface;

(e) said rotary brush has opposite ends and a middle portion;

(f) said row of bristles is arrayed in a right hand helix from said middle portion toward one end of said rotary brush and is arrayed in a left hand helix from said middle portion of said rotary brush toward an opposite end of said rotary brush;

(g) rotary motor means drivingly engaged with said rotary brush to rotate same; and (h) an elongated shoe rest bar mounted on said housing substantially parallel to said axis and positioned at a higher elevation than said axis such that a user rests an instep portion of the user's shoe on said bar and pivots the shoe thereon to thereby vary the degree of engagement between a sole of the shoe and said rotary brush.

* * * * *